US009259948B2

(12) United States Patent
Wanibe

(10) Patent No.: US 9,259,948 B2
(45) Date of Patent: Feb. 16, 2016

(54) PRINTING APPARATUS

(71) Applicant: SEIKO EPSON CORPORATION, Tokyo (JP)

(72) Inventor: Akihisa Wanibe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/205,956

(22) Filed: Mar. 12, 2014

(65) Prior Publication Data

US 2014/0285578 A1 Sep. 25, 2014

(30) Foreign Application Priority Data

Mar. 22, 2013 (JP) ..... 2013-059561

(51) Int. Cl.

| | |
|---|---|
| ***B41J 2/14*** | (2006.01) |
| ***B41J 2/16*** | (2006.01) |
| ***B41J 25/34*** | (2006.01) |
| *B41J 2/175* | (2006.01) |

(52) U.S. Cl.

CPC ..... *B41J 25/34* (2013.01); *B41J 2/1752* (2013.01); *B41J 2/17509* (2013.01); *B41J 2/17513* (2013.01)

(58) Field of Classification Search

None

See application file for complete search history.

(56) References Cited

U.S. PATENT DOCUMENTS

| | | | | | |
|---|---|---|---|---|---|
| 3,052,000 | A * | 9/1962 | Ferrett | E04B 2/827 | 49/127 |
| 5,943,529 | A * | 8/1999 | Miyabe et al. | 399/111 | |
| 6,375,315 | B1 * | 4/2002 | Steinmetz et al. | 347/86 | |
| 6,575,557 | B2 * | 6/2003 | Tominaga | 347/37 | |
| 7,192,128 | B1 * | 3/2007 | Hattori et al. | 347/86 | |
| 7,237,885 | B1 * | 7/2007 | Sasaki et al. | 347/86 | |
| 2002/0113851 | A1 * | 8/2002 | Sasaki et al. | 347/85 | |
| 2004/0155914 | A1 * | 8/2004 | Nellen et al. | 347/8 | |
| 2004/0183856 | A1 * | 9/2004 | Yang | 347/49 | |
| 2007/0115321 | A1 * | 5/2007 | Yamaguchi | 347/37 | |
| 2007/0222839 | A1 * | 9/2007 | Sasaki et al. | 347/86 | |
| 2011/0102504 | A1 | 5/2011 | Wanibe | | |
| 2012/0019599 | A1 | 1/2012 | Izawa et al. | | |
| 2012/0144627 | A1 * | 6/2012 | Liebscher | E05D 15/0608 | 16/96 R |
| 2014/0183817 | A1 * | 7/2014 | Hwang | B65H 31/3063 | 271/306 |

FOREIGN PATENT DOCUMENTS

| | | | |
|---|---|---|---|
| JP | 08277028 | A * | 10/1996 |
| JP | 08319021 | A * | 12/1996 |
| JP | 10202894 | A * | 8/1998 |
| JP | 2003-127343 | | 5/2003 |
| JP | 2006088650 | A * | 4/2006 |
| JP | 2007007920 | A * | 1/2007 |
| JP | 2009-274377 | | 11/2009 |
| JP | 2011-093174 | | 5/2011 |
| JP | 2012-025053 | | 2/2012 |
| WO | WO 2013162595 | A1 * | 10/2013 |

* cited by examiner

*Primary Examiner* — Julian Huffman
*Assistant Examiner* — Leonard S Liang
(74) *Attorney, Agent, or Firm* — Workman Nydegger

(57) ABSTRACT

A printing apparatus including a head unit in which a print head is mounted on a head plate, and a small carriage that holds the head unit. The head unit engages with a slide rail formed in the small carriage with an engagement protrusion, and can be attached and detached in a sliding manner when the head unit is attached and detached.

7 Claims, 9 Drawing Sheets

PRINTING APPARATUS

BACKGROUND

1. Technical Field

The present invention relates to a printing apparatus equipped with a head unit on which a plurality of print heads are mounted.

2. Related Art

Hitherto, large printers have required a large head unit in which a number of droplet ejection heads (print heads) are mounted on a single carriage (head plate). Replacement of such a large head unit needs to be carried out in such large printers.

A head unit is known that includes, in order to efficiently carry and set such a large carriage, a plurality of droplet ejection heads, a carriage in which the plurality of droplet ejection heads are mounted so as to protrude from the back side of the carriage, and a pair of left and right handles provided on the front side of the carriage to allow the carriage to be carried by hand (JP-A-2003-127343). The head unit is first placed on a temporary table that is positioned at a somewhat higher position than a set stage (carriage) when the head unit is installed in the set stage. The operator holds the pair of left and right handles that are provided on the front side of the carriage, tilts the head unit so as to lower the end of the head unit and slides the head unit along the temporary table, abuts the end against a stopper of the set stage, and further lowers the head unit so that the head unit is loaded onto the set stage. Furthermore, since the operator holds the pair of left and right handles, the head unit can be carried while maintaining its setting position; accordingly, the head unit can be attached and detached in a stable and safe manner even if the head unit is large.

The above-described head unit is loaded onto the set stage by sliding the head unit while the head unit is tilted so as to lower the end of the head unit; accordingly, the operator needs to disadvantageously hold on to the handle and maintain the tilted position of the head unit until mounting of the head unit is completed. Accordingly, a large space is required on the upper side of the set stage to carry out the attaching and detaching operation and, as a result, the device becomes disadvantageously large.

Furthermore, when the head unit is installed at various angles that are not parallel to the floor surface or when installing the head unit to a high position, disadvantageously, the position of the operator during work becomes unstable and the attaching and detaching work becomes difficult.

SUMMARY

An advantage of some aspects of the invention is that a printing apparatus is provided in which a head unit on which print heads are mounted can be easily attached and detached to and from a carriage in a smooth manner.

The invention has been made to overcome at least some of the disadvantages described above and can be implemented in the following modes and exemplary applications.

First Exemplary Application

A printing apparatus according to the present exemplary application includes a head unit including a head plate on which a print head is mounted and a carriage that holds the head unit, in which the carriage includes a connection plate that serves as a guide surface of the head unit when the head unit is attached and detached to and from the carriage in a sliding manner, and the connection plate is provided with a slide rail that extends in an attaching and detaching direction, and the head unit is provided with an engagement protrusion that engages with the slide rail.

According to the present exemplary application, the head unit can be mounted on the carriage by putting the engagement protrusion that is provided near an end of the head unit to the slide rail of the carriage and pushing the head unit along the slide rail. Furthermore, in the reverse order, the head unit can be detached from the carriage by pulling the head unit along the slide rail and out of the carriage. In other words, the head unit on which the print head is mounted can be attached and detached easily and in a smooth manner to and from the carriage. In such a case, since the printing apparatus is structured so that the head unit is attached and detached with a sliding method, a large space to attach and detach the head unit is not needed on the upper side of the carriage.

In such a case, the carriage preferably includes the slide rail, which guides the head unit along an attaching and detaching path, a first positioning member, on one side in the sliding direction, that sets the position of the head unit that has been mounted, and a second positioning member, on the other side in the sliding direction, that sets the position of the head unit that has been mounted.

Second Exemplary Application

In the printing apparatus according to the first exemplary application, a path of the slide rail preferably includes a bending portion that bends in a direction that intersects the attaching and detaching direction.

According to the present exemplary application, even if there are other components of the device obstructing the path of the head unit when the head unit is attached and detached, there is a slide rail formed along a path that averts these components; accordingly, it will be possible to correspond to the arrangement of the components in a flexible manner.

Third Exemplary Application

In the printing apparatus according to the first exemplary application, the slide rail preferably branches into a plurality of directions in the course of extending in a detachment direction of the head unit from a position where the head unit that has been mounted is positioned.

According to the present exemplary application, similar to the second exemplary application, even if there are other components of the device obstructing the path of the head unit when the head unit is attached and detached and even if there are a plurality of carriages, there is a path that averts these formed on the same connection plate; accordingly, it is possible to correspond to the arrangement of the components in a flexible manner and, by communalizing the components, it is possible to achieve cost reduction.

Fourth Exemplary Application

In the printing apparatus according to the first exemplary application, the engagement protrusion preferably has a cylindrical shape and is preferably provided in the head unit in a rotatable manner.

The present exemplary application allows the engagement protrusion to slide in a smooth manner in the slide rail formed in the connection plate. Furthermore, as in the second exemplary application, even if the slide rail is bent at its intermediate portion, if the engagement protrusion is cylindrical, the engagement protrusion will not be caught and ease of operation can be increased.

Fifth Exemplary Application

In the printing apparatus according to the first exemplary application, a plurality of the engagement protrusions are preferably arranged in a row in the attaching and detaching direction.

According to the present exemplary application, while the head unit is slid along the slide rail formed in the connection plate, the sliding direction of the head unit can be automatically maintained and the position of the head unit can be restricted; accordingly, it is possible to avoid the head unit from crashing into other components.

Sixth Exemplary Application

In the printing apparatus according to the first exemplary application, the engagement protrusion preferably has, on a root side of the engagement protrusion, a constricted portion that is narrower than a tip side of the engagement protrusion, and the slide rail preferably has a shape that allows the engagement protrusion including the constricted portion to fit in the slide rail.

According to the present exemplary application, while attaching or detaching of the head unit to or from the carriage is carried out, an auxiliary plate, which supports the engaged state of the engagement protrusion with the slide rail formed in the connection plate, is not needed to maintain the engaged state; accordingly, miniaturization of the small carriage can be carried out.

Seventh Exemplary Application

In the printing apparatus according to the first exemplary application, the engagement protrusion is preferably provided near a front side of the head unit, the front side being a side at the front when the head unit is being mounted into the carriage.

According to the present exemplary application, while attaching or detaching of the head unit to or from the carriage is carried out, it is possible to maintain the engaged state of the engagement protrusion with the slide rail in the connection plate for a longer time; accordingly, the advantageous effects of the first to sixth exemplary applications can be exerted to their fullest potential.

Eighth Exemplary Application

In the printing apparatus according to the first exemplary application, the slide rail preferably has a wide-width portion, the wide-width portion being wider than the other portions of the side rail, in a portion where the engagement protrusion is positioned when positioning of the head unit is carried out after the head unit is mounted on the carriage.

According to the present exemplary application, immediately before the position of the head unit with respect to the carriage is ultimately set, the restriction imposed by the slide rail and the engagement protrusion is removed; accordingly, fitting carried out by the positioning member can be prioritized and the final positioning can be carried out without any difficulties.

Ninth Exemplary Application

In the printing apparatus according to the first exemplary application, the slide rail and the engagement protrusion that engages with the slide rail are arranged on both sides of the head unit.

According to the present exemplary application, when the head unit is attached and detached to and from the carriage, the head unit is held from both sides in a stable manner; accordingly, the above advantageous effects of the above exemplary applications can be obtained even more.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
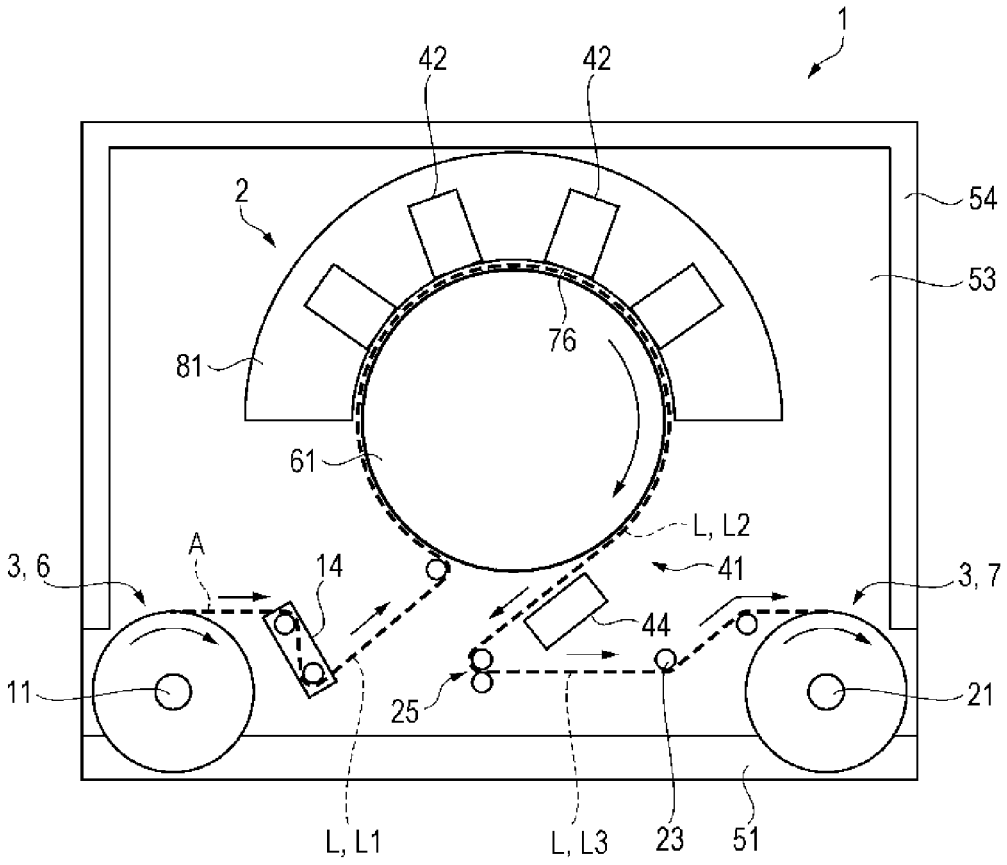
FIG. 1 is a front view of an ink jet device according to a first exemplary embodiment.

Ink jet devices that are printing apparatuses according to exemplary embodiments of the invention will be described below with reference to the accompanying drawings. FIG. 1 is a front view of an ink jet device according to an exemplary embodiment.

An ink jet device 1 illustrated in FIG. 1 is a center drum type printing apparatus in which a plurality of print heads are arranged in the circumferential direction of a center drum. The ink jet device 1 performs printing with UV ink (UV curable ink) on a long recording medium that is fed from reel to reel. The recording medium is a sheet-shaped medium such as a label film, paper, or the like, and mediums with various widths and thicknesses are to be targets of printing. Note that in the subsequent description, a direction perpendicular to the sheet surface of FIG. 1 is referred to as a front-rear direction in which the near side is the "front" and the far side is the "rear". Specifically, the extending direction of a rotating shaft (a drum shaft 62) of a rotary drum 61 described later is referred to as the front-rear direction, and the direction heading towards the rotary drum 61 from a drum motor 64 described later is referred to as a near side direction (near side) and the direction heading towards the drum motor 64 from the rotary drum 61 is referred to as a far side direction (far side). Furthermore, in a transport path of the recording medium, the side on which a medium feeding device 6 described later is arranged is referred to as "upstream" and the side on which a medium collecting device 7 described later is arranged is referred to as "downstream".

First Exemplary Embodiment

As illustrated in FIG. 1, which is a general view of the ink jet device 1, the ink jet device 1 includes a center drum type printing section 2 that performs printing on a recording medium A with an ink jet method, a medium feeding and collecting device 3 employing a reel-to-reel system that feeds the recording medium A to the printing section 2 and that collects the printed recording medium A, and a controller (not shown) that integrally controls these components. The medium feeding and collecting device 3 includes the medium feeding device 6 that feeds the recording medium A to the printing section 2 and the medium collecting device 7 that collects the recording medium A from the printing section 2. Meanwhile, a medium transport path L of the recording medium A constituted by the printing section 2 and the medium feeding and collecting device 3 includes a feeding transport path L1 ranging from the medium feeding device 6 to the printing section 2, an arcuate printing transport path L2 that is almost circular in shape and that is included in the printing section 2, a collecting transport path L3 ranging from the printing section 2 to the medium collecting device 7.

The recording medium A that has been sent out from the medium feeding device 6 is fed to the printing section 2 through the feeding transport path L1, and is transported along the printing transport path L2 in the printing section 2 where printing is carried out on the recording medium A. Furthermore, the recording medium A, on which printing has been completed, is wound after passing through the collecting transport path L3 and is collected by the medium collecting device 7.

The medium feeding device 6 includes a supply reel 11 that feeds the recording medium A that is wound in a roll shape, a feed motor (not shown) that rotates the supply reel 11 to feed the recording medium A, a steering unit 14 that is disposed downstream of the supply reel 11 and that carries out positioning of the recording medium A in the width direction while sending the recording medium A to the printing section 2. The medium feeding device 6 drives the feed motor while the controller synchronizes the feed motor with the printing section 2; accordingly, the recording medium A is fed from the supply reel 11 and is sent along the feeding transport path L1.

The medium collecting device 7 includes a take-up reel 21 that winds the printed recording medium A in a roll shape, a winding motor (not shown) that rotates the take-up reel 21 to wind the recording medium A, a back tension roller 23 that is disposed upstream of the take-up reel 21 and that applies back tension to the recording medium A, and a turn-back unit 25 that is disposed upstream of the back tension roller 23 and that changes the path of the collecting transport path L3 such that the recording medium A sent out from the printing section 2 is U-turned and is sent to the back tension roller 23. When the medium collecting device 7 drives the winding motor while the controller synchronizes the winding motor with the printing section 2, the recording medium A is fed from the printing section 2 and is sent along the collecting transport path L3.

As illustrated in FIG. 1, the printing section 2 includes the rotary drum 61, a medium sending mechanism 41 that sends the recording medium A along the printing transport path L2, a plurality of carriage units 42 that each have a plurality of print heads 76 and that are each disposed radially with respect to the rotary drum 61 so as to face the printing transport path L2, and a UV irradiation unit 44 for full curing that cures the UV ink on the recording medium A and that faces the collecting transport path L3. Furthermore, a chamber (not shown) covers the entire printing section 2.

Figure 2:
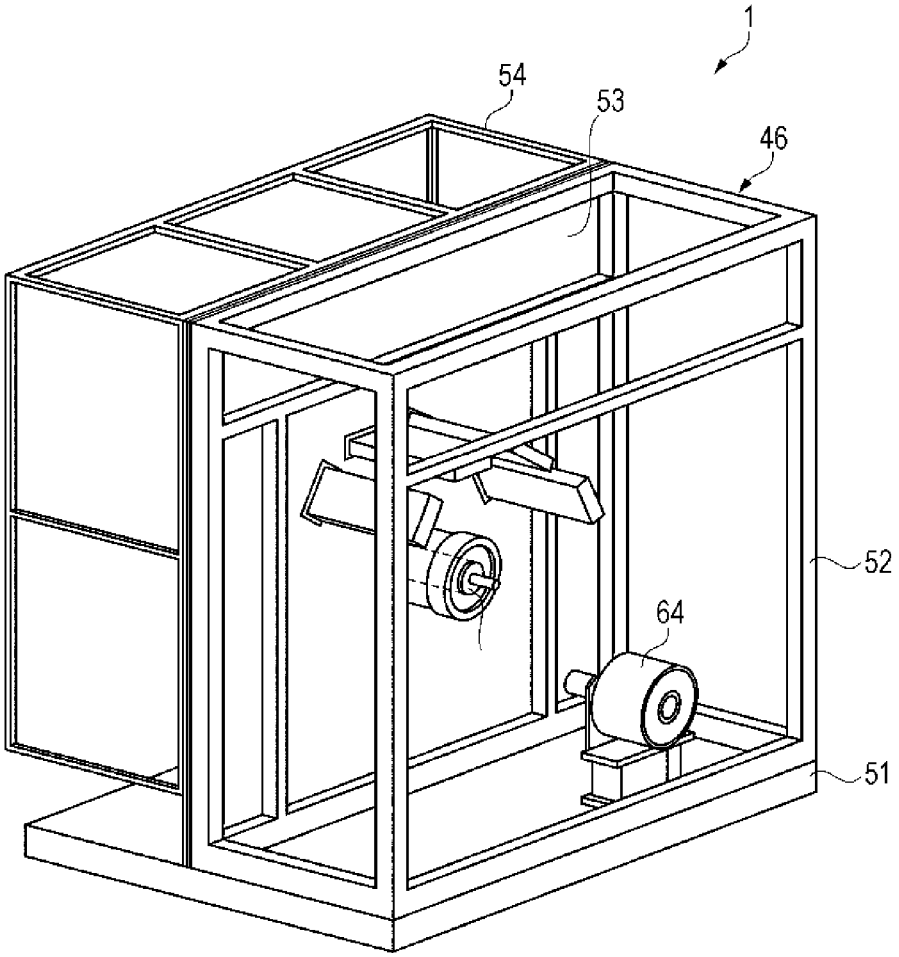
FIG. 2 is a rear perspective view of the ink jet device.

As illustrated in FIG. 2, a frame 46 of the device includes a base frame 51 that serves as the base of the device, a main frame 52 that is provided in the rear-half portion of the base frame 51 in a standing manner, a plate-shaped sub frame 53 that is provided in a wide area of the front side of the main frame 52, and a chamber frame 54 that is disposed in front of the main frame 52 with the sub frame 53 between itself and the main frame 52. A wall (not shown) is attached to each side of the main frame 52 and chamber frame 54 such that a chamber covering the entire printing section 2 is formed. In other words, the internal temperature and cleanliness of the printing section 2 are controlled by the chamber. Note that predetermined clearances are provided between the chamber frame 54 and the base frame 51. The feeding and discharging of the recording medium A can be carried out through these clearances.

Referring to FIG. 1, the plurality of carriage units 42 that are disposed in a large carriage 81 serving as their base and that are radially disposed with respect to the rotary drum 61 are ink units with different colors. The ink units, specifically, cyan (C), magenta (M), yellow (Y), and black (Bk) ink units, are disposed from the start side towards the end side of the printing transport path L2 in this order in the circumferential direction of the rotary drum 61 at substantially even intervals. A plurality of print heads 76, the details of which will be described later, are mounted on each carriage unit 42. Moreover, the recording medium A, which is transported along the printing transport path L2 for printing, sequentially faces the carriage units 42 with different colors; accordingly, color printing based on print data is carried out in a desirable manner on the recording medium A.

Figure 3:
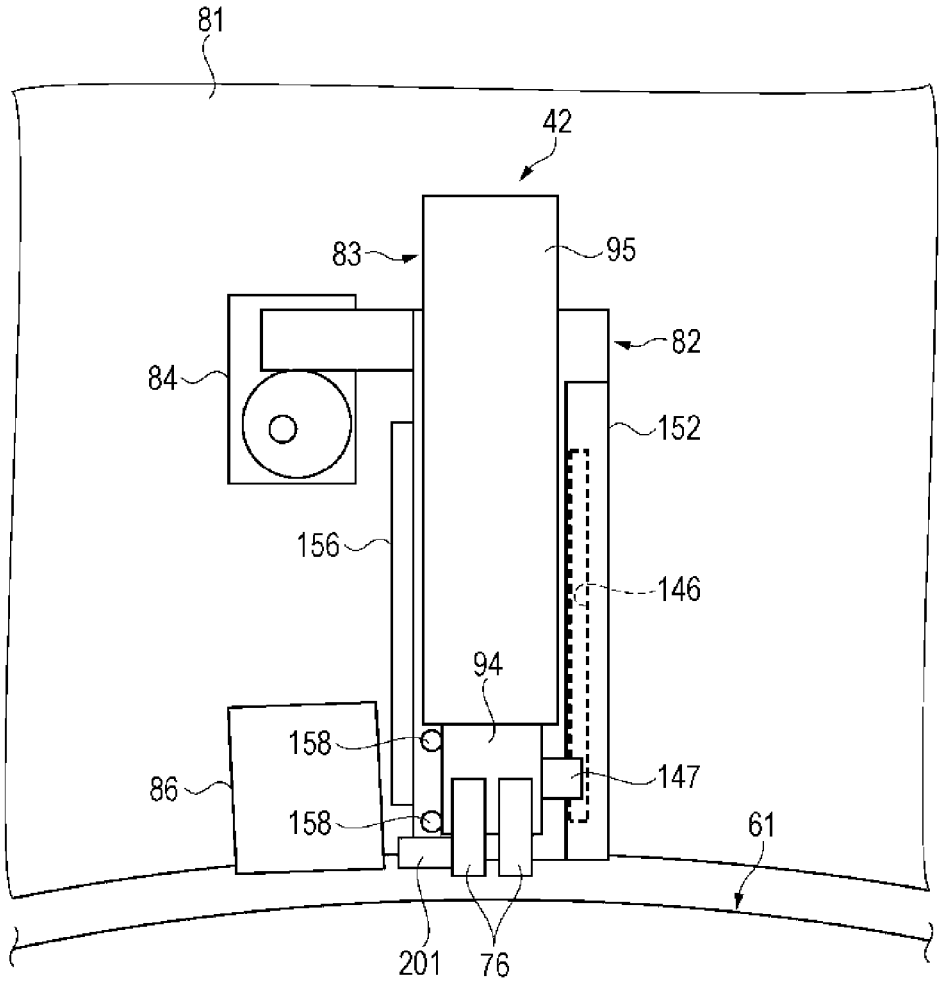
FIG. 3 is a cross-sectional view of a carriage unit and its surroundings.
Figure 4A:
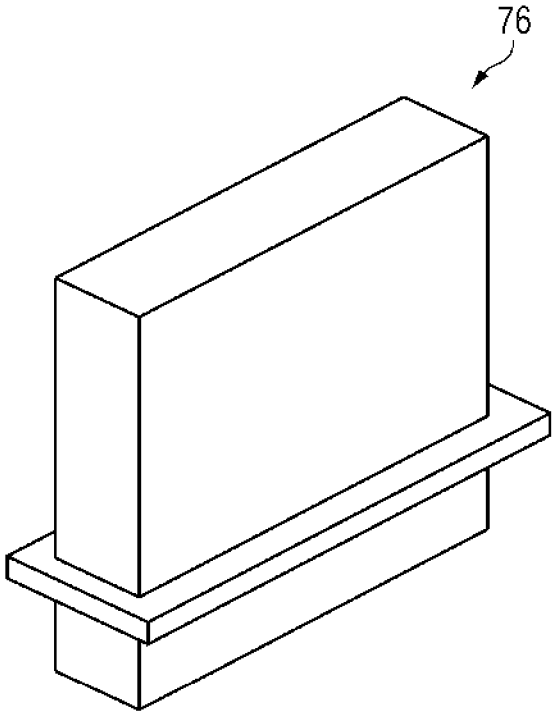
FIGS. 4A and 4B are perspective views of a print head.
Figure 4B:
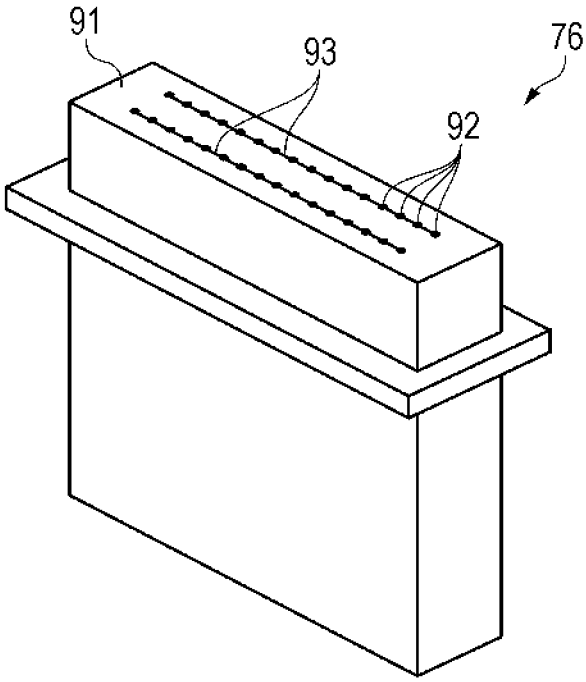
Figure 5:
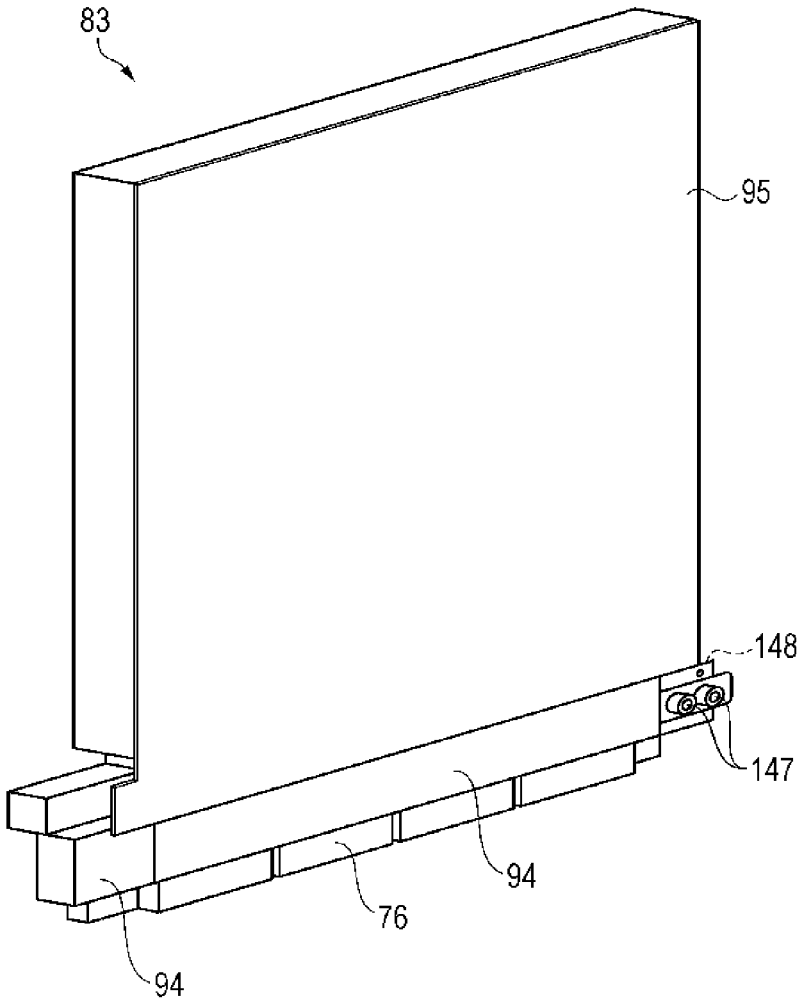
FIG. 5 is a perspective view of a head unit.
Figure 6:
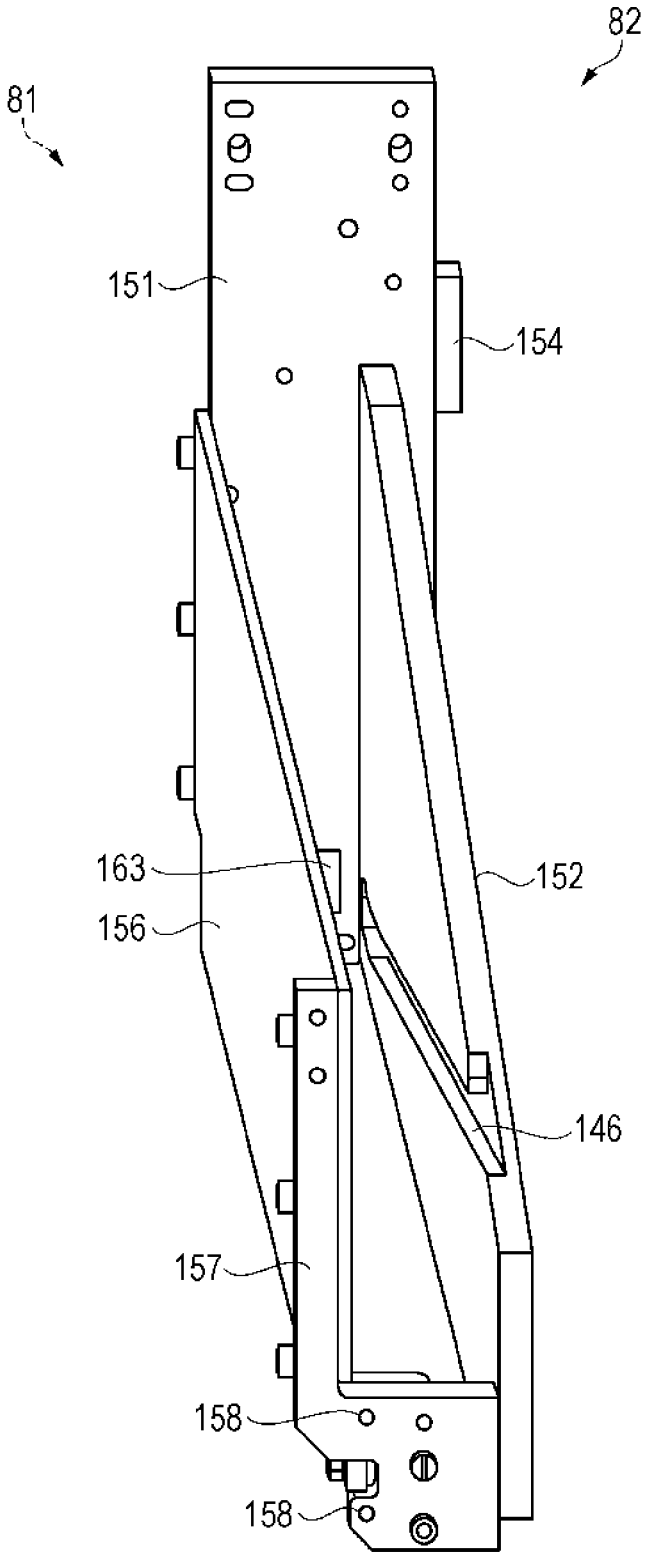
FIG. 6 is a perspective view of the small carriage and its surroundings.

The detailed configuration of each component of the printing section 2 will be described next with reference to the drawings. FIG. 3 is a cross-sectional view of a carriage unit and its surroundings. FIGS. 4A and 4B are perspective views of a print head. FIG. 5 is a perspective view of a head unit. Furthermore, FIG. 6 is a perspective view of a small carriage 82 and its surroundings.

Referring to FIG. 3, each carriage unit 42 includes a box frame type small carriage 82 that is supported by the large carriage 81 in a slidable manner, in the large carriage 81 that is fixed to the sub frame 53 described above, in a direction normal to the outer peripheral surface of the rotary drum 61 (see FIGS. 1 and 2), a head unit 83 that is mounted on the small carriage 82 and on which a plurality of print heads 76 are mounted, a Z-axis moving mechanism 84 that moves, through the small carriage 82, the head unit 83 to and fro in a direction normal to the outer peripheral surface of the rotary drum 61, and a head control substrate module (not shown) that is mounted on the small carriage 82 and that applies an ejection waveform to the plurality of print heads 76. Each carriage unit 42 further includes a pinning unit 86 that is provided on the small carriage 82 and that preliminarily cures UV ink that has landed on the recording medium A and a sub-tank unit (not shown) that is supported on the outer surface of the large carriage 81 and that supplies UV ink to the plurality of print heads 76.

The Z-axis moving mechanism 84 includes a motor driven cam mechanism, for example. The Z-axis moving mechanism 84 adjusts the clearance between the print head 76 and the recording medium A for recording mediums A having different thickness.

Viscosity of the UV ink used in the ink jet device 1 of the present exemplary embodiment is heavily dependent on temperature, in other words, the viscosity decreases with increasing temperature. Accordingly, the temperatures of the sub-tank unit described above, the plurality of print heads 76, and the ink flow paths ranging from the sub-tank unit to the plurality of print heads 76 (a main tube, a manifold, individual tubes), although not shown in the drawings, are controlled with a heater or the like. For example, UV ink is ejected after its temperature is increased to about 40° C.

As illustrated in FIG. 4B, a nozzle surface 91 of the ink jet print head 76 includes two nozzle rows 93 that are arranged parallel to each other and that are each formed of a plurality of ejection nozzles 92. In a head plate 94, the plurality of print heads 76 are arranged in the front-rear direction in a staggered manner such that the head plate 94 can operate as a long continuous head by employment of image processing methods such as print timing control. Note that the above arrangement pattern is an example and any number of print heads 76, any number of rows, and, further, any kind of arrangement patterns can be applied.

The features of the invention, in other words, the head unit 83 and the small carriage 82 will be described now in detail. The configurations of the head unit 83 and the small carriage 82 will be subsequently described first, and, then, a method of attaching and detaching the head unit 83 to and from the small carriage 82 of the carriage unit 42 will be described.

Referring to FIG. 5, the head unit 83 includes the head plate 94 and the plurality of print heads 76 installed in the head plate 94. While the present exemplary embodiment illustrates a state in which four print heads 76 are installed in the head plate 94, the number of print heads 76 can be any number. Furthermore, ink flow paths (not shown) are formed in the head plate 94, in which the ink flow paths are each connected to a corresponding print head 76. Additionally, a box-shaped cover frame 95 is fixed to an upper portion of the head plate 94. A head substrate (not shown) is accommodated inside the cover frame 95. The head substrate is electrically coupled to the print head 76. The above-described components are collectively referred to as the head unit 83 and are mounted in the carriage via a positioning mechanism.

Engagement protrusions 147 are provided on a lateral side portion of a front end of the head plate 94. In the present exemplary embodiment, two engagement protrusions 147 are provided with a predetermined spacing therebetween. The outer peripheral portion of each engagement protrusion 147 is rotatable and frictional resistance when in contact with other components is reduced; accordingly, operation can be carried out with a small operation force. Note that, not limited to a configuration in which two engagement protrusions 147 are arranged, the number of engagement protrusions 147 may be one, or may be three or more.

Referring to FIG. 6, the small carriage 82 is disposed on the front side of the large carriage 81 described above. The small carriage 82 includes a front plate 151, a connection plate 152 and an auxiliary plate 156 that are a pair of bracket-shaped side plates that are provided so as to protrude from the two end portions of the front plate 151 in the width direction towards the near side (the other side).

The front plate 151 has a rectangular shape that is elongated in the up-down direction, and guide rails (not shown) are fixed on the backside of the front plate 151. Furthermore, the guide rails are supported in a slidable manner by sliders 154 provided in the large carriage 81. Accordingly, the small carriage 82 is supported by the above-described Z-axis moving mechanism 84 (see FIG. 3) so that the small carriage 82 can be moved up and down with respect to the large carriage 81 in a direction normal to the outer peripheral surface of the rotary drum 61 (see FIGS. 1 and 3). Furthermore, the connection plate 152 and the auxiliary plate 156 that are a pair of side plates and that protrude out from the front plate 151 towards the front direction in a parallel manner each have a trapezoidal shape in which the upper side is an inclined side inclined to the front side.

A rear plate 157 is fixed to the front ends of the connection plate 152 and the auxiliary plate 156, in other words, the rear plate 157 is fixed to the opposite sides of the connection plate 152 and the auxiliary plate 156 with respect to the sides to which the front plate 151 is fitted. A pair of X engagement members 158 are provided in the rear plate 157 on the side that faces the front plate 151.

The small carriage 82 that is configured as above is substantially box shaped. The rear plate 157, the front plate 151, the connection plate 152, and the auxiliary plate 156 integrally form the box shape, in which the head unit 83 can be accommodated.

A slide rail 146 that guides the head unit 83 when the head unit 83 is being mounted is formed in the connection plate 152 of the small carriage 82 described above. The head unit 83 is slid and guided along the slide rail 146 in the extending direction of the slide rail 146. Furthermore, although not shown, holding members that set the position of the head unit 83 and that fix the head unit 83 are provided inside the small carriage 82 in the rear plate 157 and the front plate 151.

Referring to the drawings, an operation of attaching and detaching the head unit 83 to and from the small carriage 82 will be described now. FIGS. 7A to 7D are explanatory drawings schematically illustrating the operation of attaching and detaching the head unit 83 to and from the small carriage 82.

Figure 7A:
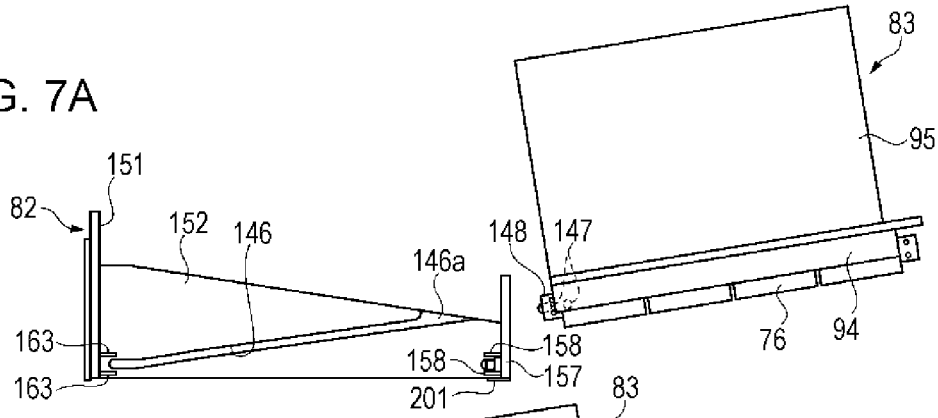
FIGS. 7A to 7D are explanatory drawings schematically illustrating an operation in which attaching and detaching of the head unit is carried out to and from the small carriage.
Figure 7B:
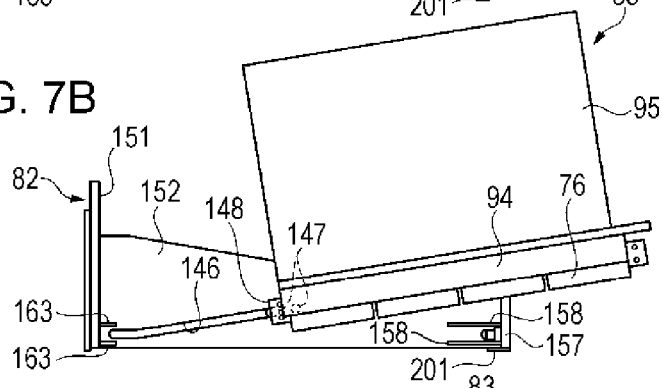

Referring to FIG. 7A, an operator first holds the cover frame 95 of the head unit 83 and carries the head unit 83 to the small carriage 82, fits the two engagement protrusions 147 provided in the end portion of the head plate 94 into a front end opening 146*a* of the slide rail 146 provided in the connection plate 152, and pushes and slides the head plate 94 in the extending direction of the slide rail 146 (see FIG. 7B).

At this time, from when both the engagement protrusions 147 are completely in the slide rail 146, the inclination angle of the head unit 83 is restricted by the angle of the slide rail 146 such that the position of the head unit 83 can be maintained. With this function, trouble such as the print head 76 crashing into the rear plate 157 when mounting the head unit 83 and breaking the head unit 83 can be prevented. Furthermore, when mounting (attaching or detaching) the head unit 83, the head unit 83, held by the operator, can be prevented from slipping through the fingers of the operator and being dropped.

Figure 7C:
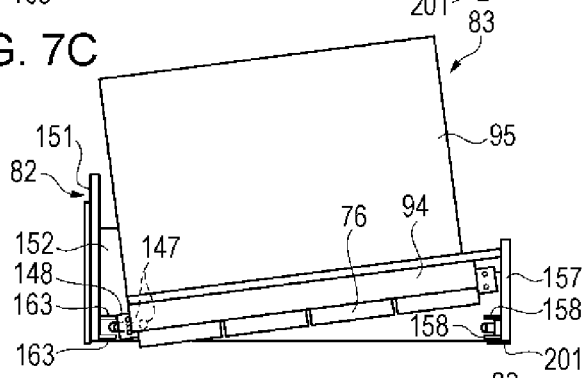

Referring next to FIG. 7C, when the head unit 83 is further guided by the slide rail 146 and is further pushed in, a front positioning surface 148 of the head plate 94 becomes abutted against and engaged with Y engagement members 163 that are attached to the front plate 151, and further, at substantially the same time, a Z direction positioning surface 148 and an X direction positioning surface 148 are pushed against and are engaged with a Z engagement member 201 and an X engagement member 158, respectively. Furthermore, the head plate 94 is secured to the small carriage 82 with a securing member (not shown) that is provided in the small carriage 82 so that the head plate 94 does not move from the position where the head plate 94 has been fixed (see FIG. 7D).

Note that the groove width of the slide rail 146 is preferably formed wider at a portion in the slide rail 146 where the engagement protrusions 147 are positioned when the head unit 83 is at a position where it is mounted on the positioning engagement members (X engagement member 158, Y engagement member 163, and Z engagement member 201) provided in the small carriage 82 described above. By widening the groove width as above, the positioning of the head unit 83 with respect to the small carriage 82 will not be affected by the restriction imposed on the engagement protrusions 147 by the slide rail 146.

Figure 7D:
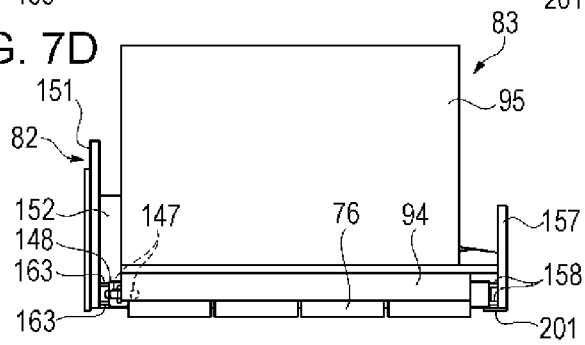

In the state illustrated in FIG. 7D in which the head unit 83 is in position and is secured to the small carriage 82, a tube that has been extended and connected from the manifold (not shown) of the print head 76 is connected to a sub tank (not shown), and a signal cable (not shown) of the head unit 83 is electrically coupled to the head control substrate module (not shown). Accordingly, mounting of the head unit 83 to the small carriage 82 is completed.

On the other hand, the operation of detaching the head unit 83 from the small carriage 82 can be carried out in the reverse order to that of the mounting operation. In other words, the operator first dismounts the ink tube from the manifold and dismounts a connector, which extends to the head control substrate module, from the head unit 83. Then, the securing members securing the head unit 83 at the front and at the back are loosened, the rear end of the head unit 83, which is the near side to the operator who is carrying out the operation from the back side of the device, is lifted up so that the head unit 83 is inclined, and the engagement protrusions 147 are drawn out along the slide rail 146. The head unit 83 can be completely detached from the small carriage 82 after the engagement protrusions 147 are detached from the slide rail 146.

According to the configuration described above, even in a case of the center drum type ink jet device 1, in which a plurality of carriage units 42 are arranged in the circumferential direction of the rotary drum 61, the head units 83 can be easily installed or detached in a smooth manner from the small carriages 82 that are disposed at various angles and with various clearances with respect to the rotary drum 61.

Second Exemplary Embodiment

Figure 8:
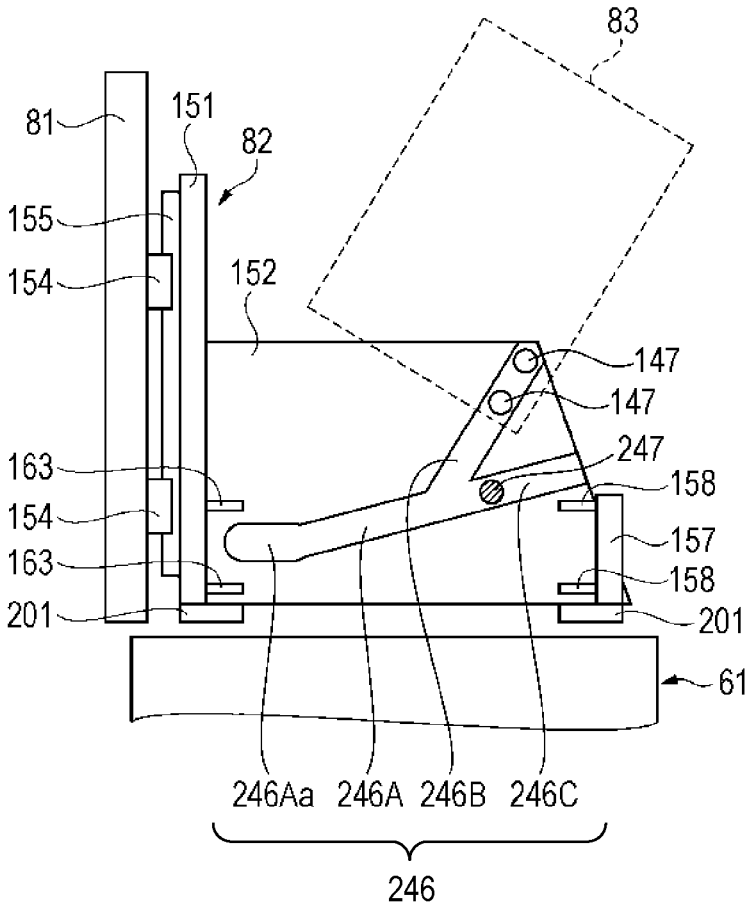
FIG. 8 is a schematic illustration of a printing apparatus according to a second exemplary embodiment of the invention.

A second exemplary embodiment of the ink jet device will be described next. FIG. 8 is a schematic illustration of a main section of the ink jet device according to the second exemplary embodiment. Note that components that are the same as those of the first exemplary embodiment are denoted with the same reference numerals and repeated descriptions thereof are omitted.

As illustrated in FIG. 8, in a slide rail 246 formed in the connection plate 152 of the small carriage 82, a path 246A of the slide rail 246 formed on the front plate 151 side branches at an intermediate portion of the connection plate 152 into paths 246B and 246C of a plurality of slide rails. As described above, in the present exemplary embodiment, two paths 246B and 246C are formed by branching the path 246A of the slide rail 246.

When attaching and detaching the head unit 83 to and from the small carriage 82 of the second exemplary embodiment in which the slide rail 246 having such a configuration is formed, the engagement protrusions 147 can be moved along either of the path 246B and path 246C that are branched paths of the path 246A. FIG. 8 illustrates a state in which the head unit 83 is attached or detached by moving the engagement protrusions 147 along the path 246B, which is one of the two paths 246B and 246C of the branched slide rail 246. In such a case, a blocking member 247 is provided near a portion where the path 246C, which is not used, branches from the path 246A. The blocking member 247 is attachable and detachable, and when the attaching or detaching of the head unit 83 is carried out by using the path 246C, the blocking member 247 can be provided near a portion where the path 246B branches from the path 246A. Regarding the blocking member 247, a screw hole may be provided near each of the portions where the paths 246B and 246C branch from the path 246A of the slide rail 246 and a screw head of the screw that is screwed into each screw hole may be used as the blocking member 247, for example.

Furthermore, a wide-width portion 246Aa that is a portion where the slide rail 246 has a wider width is formed in the slide rail 246 at a portion in the slide rail 246 where the engagement protrusions 147 are positioned when the head unit 83 is at a position where it is attached to the positioning engagement members (X engagement member 158, Y engagement member 163, and Z engagement member 201) provided in the small carriage 82, that is to say, when the engagement protrusions 147 is inserted into the path 246B or the path 246C of the slide rail 246 and the head unit 83 is mounted to the end of the path 246A on the front plate 151 side. By forming the wide-width portion 246Aa as above, the positioning of the head unit 83 with respect to the small carriage 82 will not be affected by the restriction imposed on the engagement protrusions 147 by the slide rail 246. Note that the configuration of the wide-width portion 246Aa of the slide rail 246 can be applied to the slide rail 146 of the first exemplary embodiment as well.

According to the configuration of the second exemplary embodiment described above, the following advantageous effects can be obtained in addition to the advantageous effects of the first exemplary embodiment.

With the configuration of the small carriage 82 of the second exemplary embodiment, in a case in which a plurality of small carriages 82 are radially arranged around the peripheral surface of the drum, even when, due to the positions of the small carriages 82, the components such as, for example, the sub tank, wiring, and the electrical substrate becomes an obstacle for attaching or detaching the head unit 83, it is possible to attach or detach the head unit 83 while avoiding the components of the device from interfering with the head unit 83 by selecting either one of the plurality of paths 246B and 246C of the slide rail 246.

Furthermore, since either one of the paths 246B and 246C, which are branches of the path 246A of the slide rail 246, that is not used (path 246C in FIG. 8) can be provided with the blocking member 247, trouble such as the operator using the wrong path and crashing the head unit 83 into the components of the device can be averted.

Note that in the second exemplary embodiment, if there is no possibility of the operator using the wrong path, the blocking members 247 do not have to be essential components disposed in the plurality of paths 246B and 246C, which are branches of the slide rail 246.

Furthermore, the number of paths that branches from the path 246A of the slide rail 246 is not limited to two such as the paths 246B and 246C of the second exemplary embodiment, the paths may be formed in a plural number such as three or more, and, further, junctions may be provided in a plural number such as two or more as required.

Third Exemplary Embodiment

Figure 9:
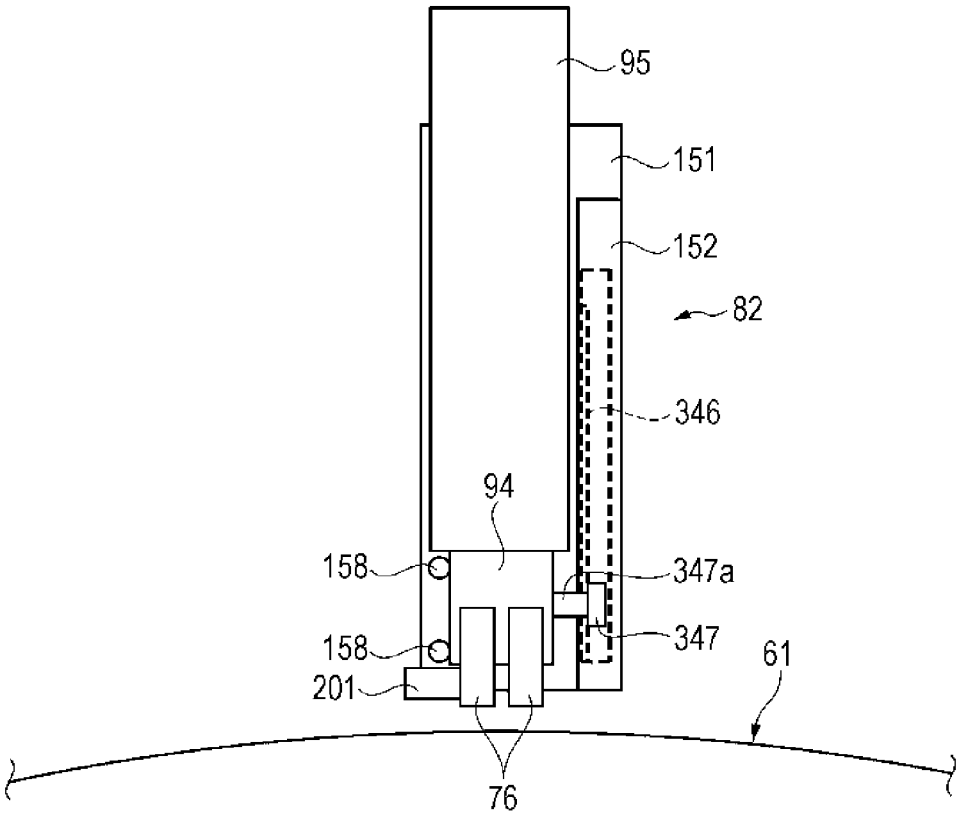
FIG. 9 is a schematic illustration of a printing apparatus according to a third exemplary embodiment of the invention.

A third exemplary embodiment will be described now with reference to FIG. 9. FIG. 9 is an illustration of a main portion of the ink jet device according to the third exemplary embodiment. The ink jet device according to the present exemplary embodiment will be described with reference to the drawing. Note that components that are the same as those of the first exemplary embodiment are denoted with the same reference numerals and repeated descriptions thereof are omitted.

As illustrated in FIG. 9, engagement protrusions 347 are provided in the head plate 94 of the head unit 83 of the third exemplary embodiment in which a constricted portion 347*a* that is narrower with respect to the dimension of the tip side of the engagement protrusion 347 is formed on the root side of the head plate 94.

Furthermore, a shape of a groove of a slide rail 346 formed in the connection plate 152 of the small carriage 82 is shaped so that the engagement protrusions 347 including the constricted portions 347*a* can be fitted into the groove.

The configuration of the third exemplary embodiment described above can obtain the following advantageous effects in addition to those of the first and second exemplary embodiments.

Specifically, as configured in the third exemplary embodiment, with the combination of the engagement protrusions 347, which has the constricted portion 347*a* on its root side with respect to the head plate 94 of the head unit 83, and the slide rail 346 of the connection plate 152, which has a groove shape into which the engagement protrusions 347 fit, owing to the fit-into structure, the head unit 83 can be attached and detached to and from the small carriage 82 without the head unit 83 being derailed from the slide rail 346 while maintaining its position. Accordingly, the head unit 83 can be attached and detached to and from the small carriage 82 in a stable manner without the head unit 83 being dropped.

Furthermore, the auxiliary plate 156 (see FIG. 6) described in the configuration of the first exemplary embodiment will not be needed in the small carriage 82; accordingly, the small carriage 82 can be made more slim and contribution to miniaturization of the overall ink jet device can be made.

As in the above description, the exemplary embodiments of the invention that has been made by the inventors have been described in detail; however, the invention is not limited to the embodiments described above and various modifications that do not depart from the scope of the invention can be made.

For example, in the exemplary embodiments described above, the holding mechanism including either the slide rails 146, 246, or 346 that is formed in the connection plate 152 of the small carriage 82 and either the engagement protrusions 147 or 347 that is provided in the head plate 94 of the head unit 83 are provided only on one side of the head plate 94.

Not limited to the above configurations, the holding mechanism including either the slide rails 146, 246, or 346 and either the engagement protrusions 147 or 347 may be provided on both sides of the head plate 94.

The entire disclosure of Japanese Patent Application No. 2013-059561, filed Mar. 22, 2013 is expressly incorporated by reference herein.

What is claimed is:

1. A printing apparatus, comprising:

a head unit including a head plate on which a print head is mounted; and a carriage that holds the head unit, wherein the carriage includes a connection plate that serves as a guide surface of the head unit when the head unit is attached and detached to and from the carriage in a sliding manner, and the connection plate is provided with a slide rail that extends in an attaching and detaching direction, and the head unit is provided with an engagement protrusion that engages with the slide rail, the slide rail includes paths which branch into a plurality of directions in the course of extending in a detachment direction of the head unit from a position where the head unit that has been mounted is positioned, each of the paths having a different terminal end of the slide rail.

2. The printing apparatus according to claim 1, wherein a path of the slide rail includes a bending portion that bends in a direction that intersects the attaching and detaching direction.

3. The printing apparatus according to claim 1, wherein the engagement protrusion has a cylindrical shape and is provided in the head unit in a rotatable manner.

4. The printing apparatus according to claim 1, wherein a plurality of the engagement protrusions are arranged in a row in the attaching and detaching direction.

5. The printing apparatus according to claim 1, wherein the engagement protrusion is provided near a front side of the head unit, the front side being a side at the front when the head unit is being mounted into the carriage.

6. The printing apparatus according to claim 1, wherein the slide rail has a wide-width portion, the wide-width portion being wider than the other portions of the side rail, in a portion where the engagement protrusion is positioned when positioning of the head unit is carried out after the head unit is mounted on the carriage.

7. The printing apparatus according to claim 1, wherein the slide rail and the engagement protrusion that engages with the slide rail are arranged on both sides of the head unit.

* * * * *